US012195232B2

(12) United States Patent
Tsai et al.

(10) Patent No.: US 12,195,232 B2
(45) Date of Patent: Jan. 14, 2025

(54) TRAY

(71) Applicant: DARWIN PRECISIONS CORPORATION, Hsinchu County (TW)

(72) Inventors: Ming Chin Tsai, Hsinchu County (TW); Cheng Yeh Tsai, Hsinchu County (TW)

(73) Assignee: DARWIN PRECISIONS CORPORATION, Hsinchu County (TW)

( * ) Notice: Subject to any disclaimer, the term of this patent is extended or adjusted under 35 U.S.C. 154(b) by 14 days.

(21) Appl. No.: 18/107,018

(22) Filed: Feb. 8, 2023

(65) Prior Publication Data

US 2024/0150073 A1 May 9, 2024

(30) Foreign Application Priority Data

Nov. 9, 2022 (TW) ..... 111142802

(51) Int. Cl.
*B65D 21/08* (2006.01)
*B65D 1/34* (2006.01)

(52) U.S. Cl.
CPC ..... *B65D 21/083* (2013.01); *B65D 1/34* (2013.01)

(58) Field of Classification Search
CPC ..... B65D 25/10; B65D 71/70; B65D 19/44; B65D 21/083; B65D 1/34
See application file for complete search history.

(56) References Cited

U.S. PATENT DOCUMENTS

| | | | | |
|---|---|---|---|---|
| 2015/0096915 | A1* | 4/2015 | Roberge | B65D 1/34 206/476 |
| 2015/0151870 | A1* | 6/2015 | Shin | B65D 85/48 206/557 |
| 2018/0037359 | A1* | 2/2018 | Gilligan | B65D 1/34 |
| 2021/0365917 | A1* | 11/2021 | Tusia Cohen | G06K 7/10297 |
| 2022/0185537 | A1* | 6/2022 | Carpenter | B65D 19/06 |

FOREIGN PATENT DOCUMENTS

| | | | |
|---|---|---|---|
| CN | 109229721 | A | 1/2019 |
| CN | 216140307 | U | 3/2022 |
| CN | 216547381 | U | 5/2022 |
| TW | M362212 | U1 | 8/2009 |

* cited by examiner

*Primary Examiner* — Shawn M Braden

(57) ABSTRACT

A tray includes a bottom plate, a surrounding wall, and limit blocks. The surrounding wall surrounds a periphery of the bottom plate. A plurality of protrusions are arranged on an inner side of the surrounding wall. The limit blocks are separably assembled on the bottom plate. Each of the limit blocks has a limit groove and a limit portion. The limit groove is adapted to be clamped with one of the protrusions. The limit portion is positioned on an opposite side of the limit groove. In this way, the tray may correspond to plates of different sizes via the limit blocks.

8 Claims, 6 Drawing Sheets

TRAY

FIELD OF THE INVENTION

The present invention relates to a tray, and more particularly to a tray for packaging plate-shaped parts.

BACKGROUND OF THE INVENTION

A tray is an item that can be used to transport or store panel products, and has the advantages of light weight, high structural strength, etc. It is suitable for packaging products with specific shapes in application and is suitable for packaging products mechanically or automatically without additional buffer materials during packing. Therefore, the production efficiency of products can be improved while manpower is saved.

The size of an existing tray is mainly designed according to the size of a matched panel. In other words, a panel factory needs to prepare various trays of different sizes to correspond to various panels of different sizes it produces. In this case, a new tray will be required once a new size of panel is added. Alternatively, when a certain panel is out of production, the corresponding tray may not be available. Therefore, the inconvenience and waste in production/storage are caused.

SUMMARY OF THE INVENTION

The present invention provides a tray, which can form storage regions of different sizes, so as to correspond to plate-shaped parts of different sizes.

To achieve the above advantage, an embodiment of the present invention provides a tray, including a bottom plate, a surrounding wall, and limit blocks. The surrounding wall surrounds a periphery of the bottom plate. A plurality of protrusions are arranged on an inner side of the surrounding wall. The limit blocks are separably assembled on the bottom plate. Each of the limit blocks has a limit groove and a limit portion. The limit groove is adapted to be clamped with one of the protrusions. The limit portion is positioned on an opposite side of the limit groove.

In an embodiment of the present invention, each of the above limit blocks is of a thin shell structure and has an opening in a side facing the bottom plate, and each of the limit blocks further has at least one outer flange extending from the limit portion.

In an embodiment of the present invention, the above bottom plate has a plurality of grooves adjacent to the protrusions, respectively, and a contour of each of the grooves corresponds to a contour of each of the limit blocks.

In an embodiment of the present invention, a depth of each of the above grooves is equal to a thickness of the outer flange.

In an embodiment of the present invention, a positioning groove is further arranged in each of the above grooves, and a positioning bump adapted to be mounted on the positioning groove is arranged on the outer flange.

In an embodiment of the present invention, the above limit groove has a bottom and a groove hole that are opposite to each other, and two limit walls that are positioned between the bottom and the groove hole and are opposite to each other, and the two limit walls and the bottom are adapted to abut against the corresponding limit block.

In an embodiment of the present invention, each of the above limit walls has a first limit structure, and each of the protrusions is provided with a second limit structure adapted to be combined with the first limit structure.

In an embodiment of the present invention, there is a distance between the first limit structure and an edge of either side of each of the limit walls.

In an embodiment of the present invention, the above bottom has a limit bulge, and each of the protrusions is provided with a limit recess adapted to be combined with the limit bulge.

According to the above description, the tray in the present invention can form storage spaces corresponding to products of different sizes by assembling and connecting the limit blocks, so as to correspond to parts of different sizes. In addition, since the service life of the same tray can be prolonged by arranging the plurality of limit blocks with different sizes and smaller relative volumes, the inconvenience in storage and production is reduced.

DETAILED DESCRIPTION OF PREFERRED EMBODIMENTS

Hereinafter, the terms used in the description of the embodiments according to the present invention, such as the description of orientational or positional relationships indicated by "up", "down", and the like, are described according to the orientational or positional relationships shown in the figures used. The above terms are merely for the convenience of describing rather than limiting the present invention, that is to say, they do not indicate or imply that the element mentioned must have a specific orientation or be constructed in a specific orientation. In addition, the terms "first", "second", and the like mentioned in this specification or the scope of the patent application are only used to name the elements or distinguish different embodiments or scopes, rather than to limit the upper or lower limit of the number of elements.

Figure 1:
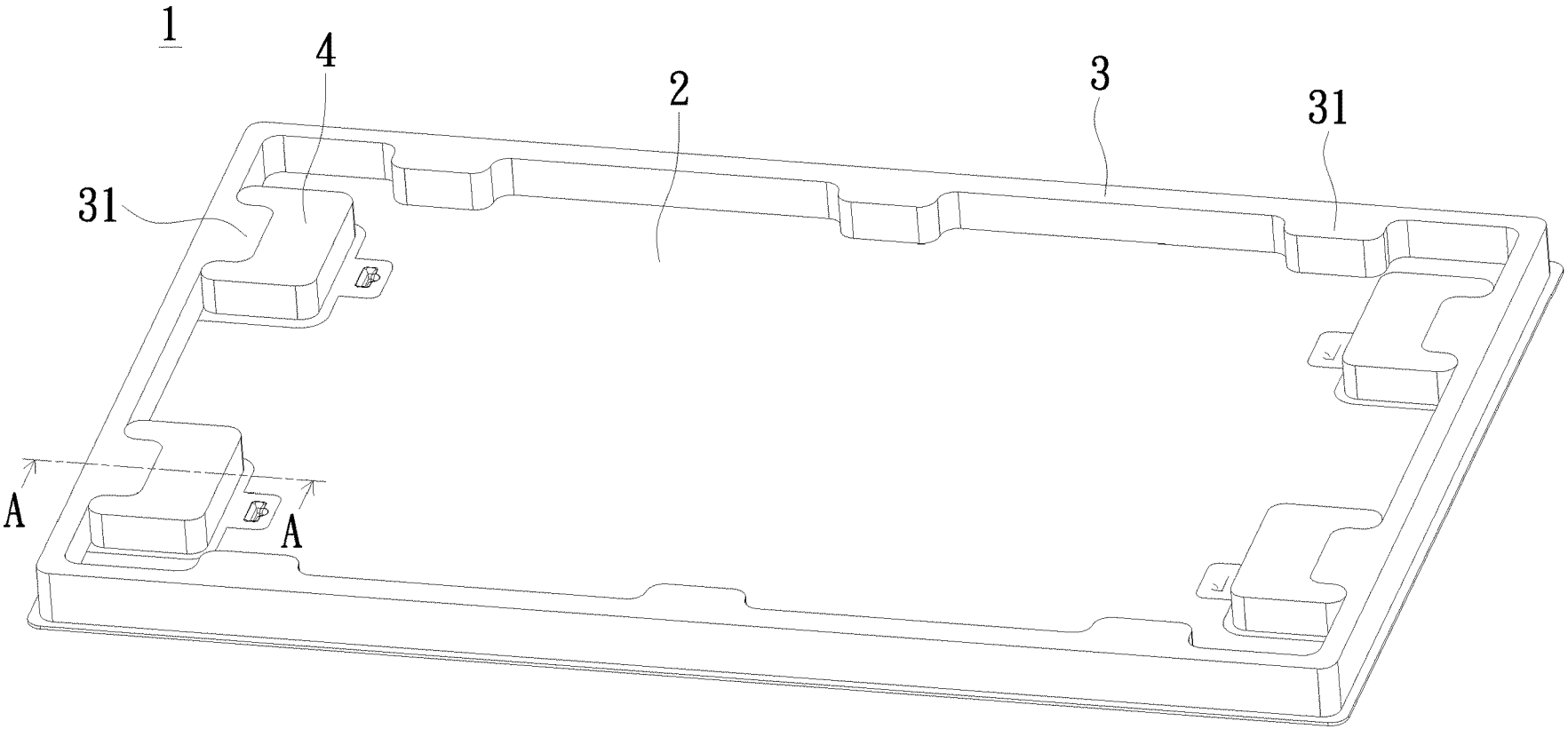
FIG. 1 is a schematic three-dimensional view of an embodiment of a tray in the present invention.
Figure 2:
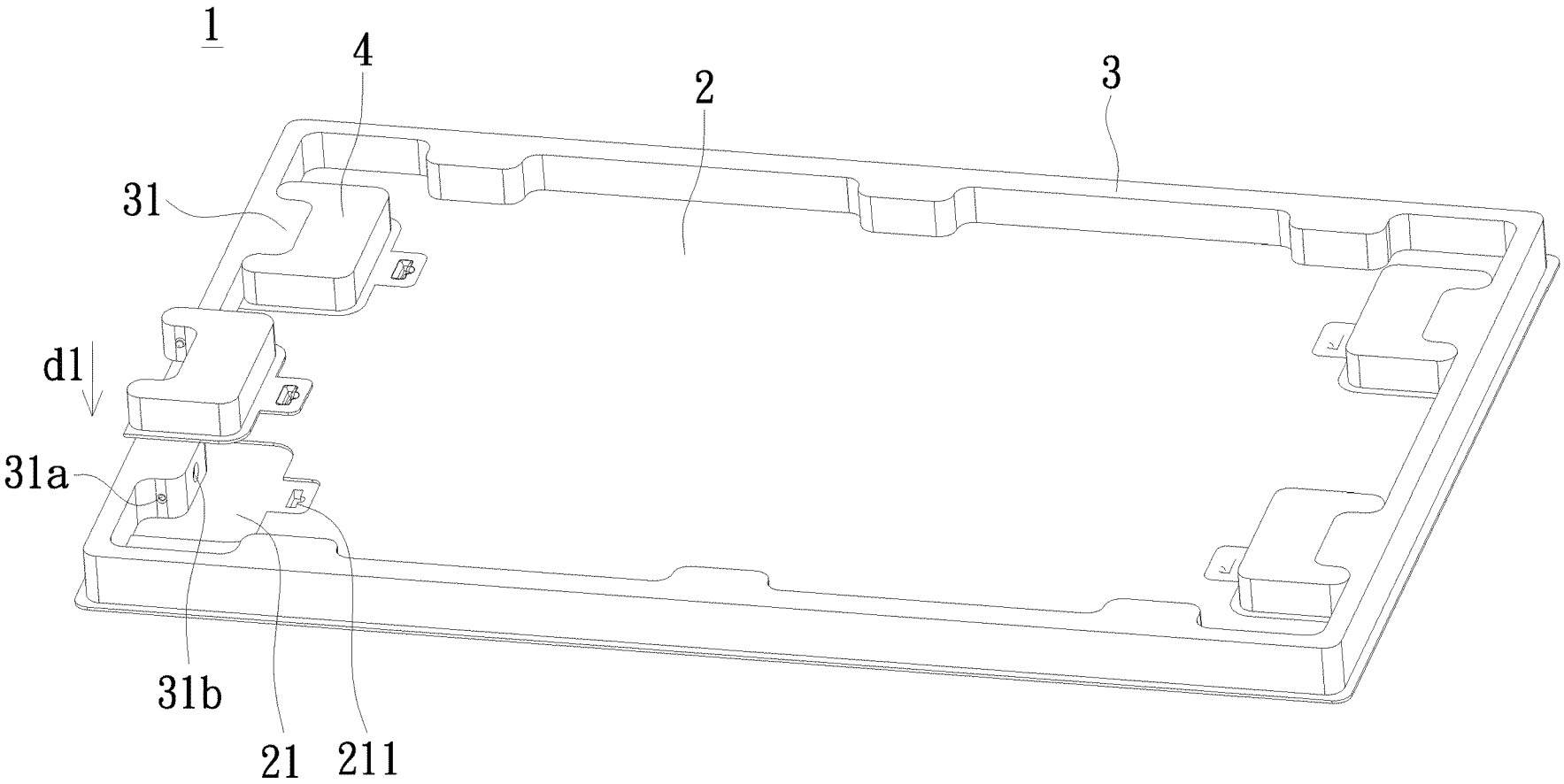
FIG. 2 is a schematic diagram of separation of one limit block from a surrounding wall in FIG. 1.
Figure 3A:
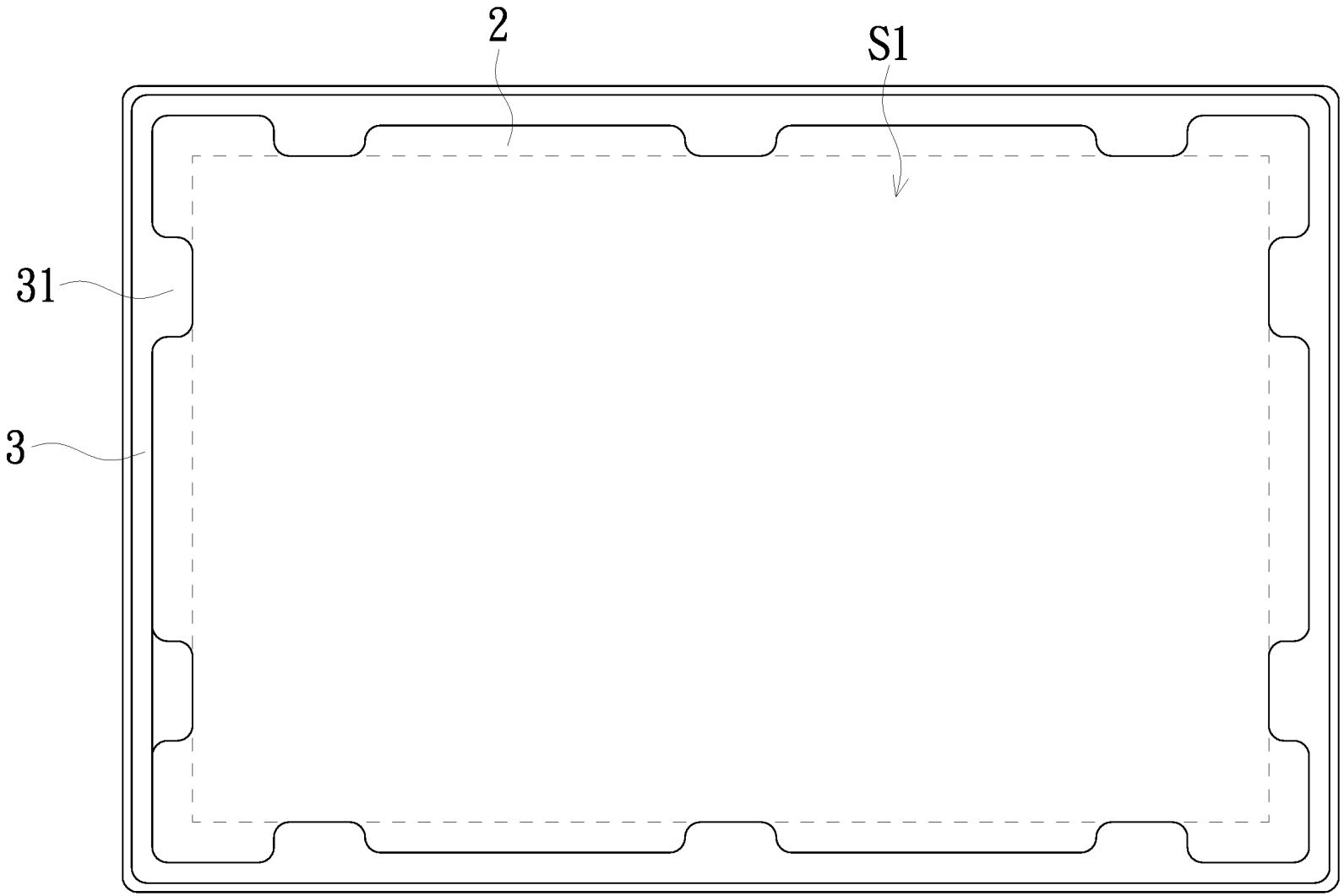
FIG. 3A is a schematic diagram of use during separation of the limit block of the tray in FIG. 1.
Figure 3B:
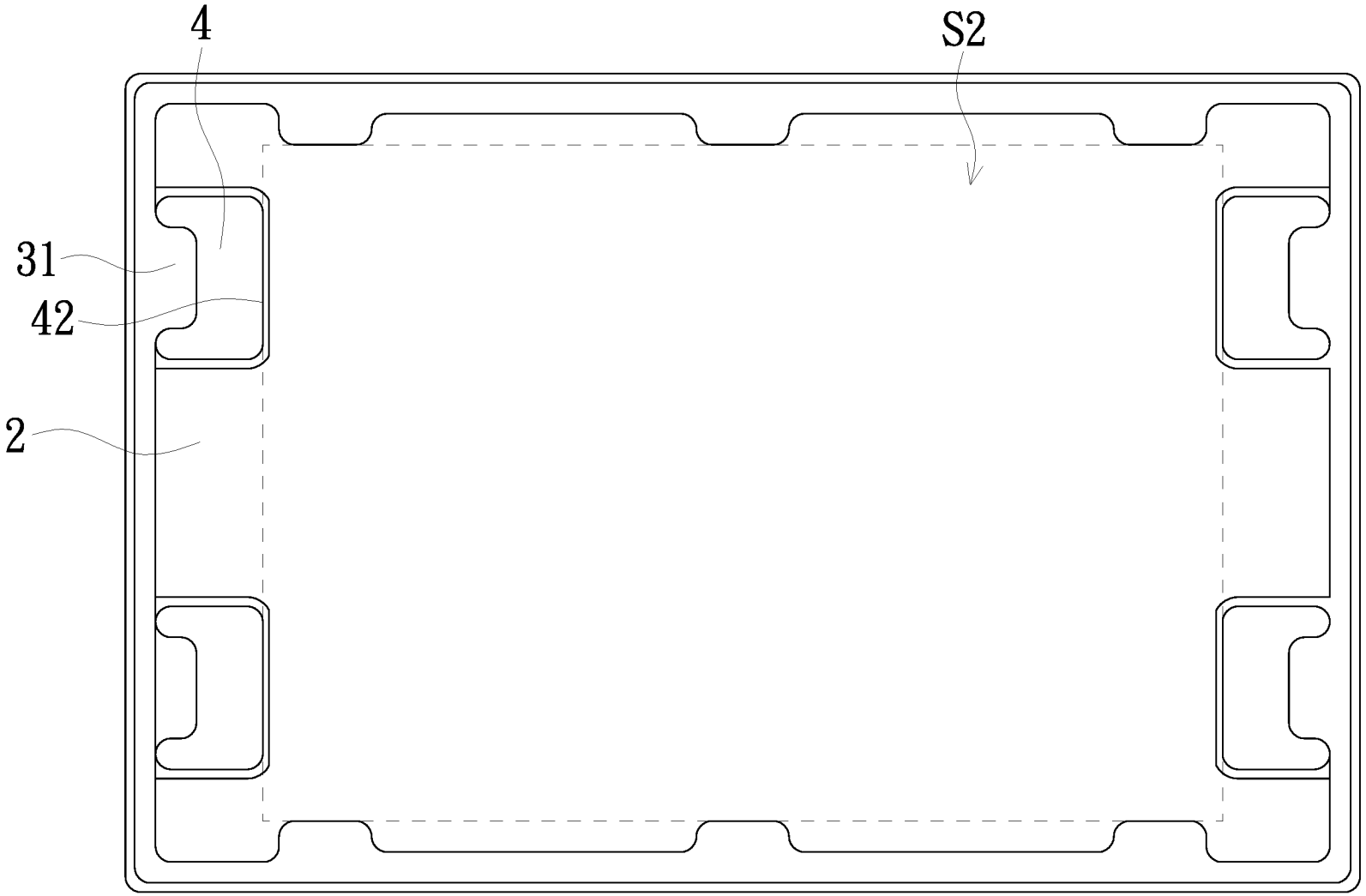
FIG. 3B is a schematic diagram of use of the tray in FIG. 1.

FIG. 1 is a schematic three-dimensional view of an embodiment of a tray in the present invention. FIG. 2 is a schematic diagram of separation of one limit block from a surrounding wall in FIG. 1. FIG. 3A is a schematic diagram of use during separation of the limit block of the tray in FIG. 1. FIG. 3B is a schematic diagram of use of the tray in FIG. 1. Referring to FIG. 1 to FIG. 3B, a tray 1 in this embodiment includes a bottom plate 2, a surrounding wall 3, and a plurality of limit blocks 4. The surrounding wall 3 surrounds a periphery of the bottom plate 2. A plurality of protrusions 31 are arranged on an inner side of the surrounding wall 3. The limit blocks 4 are adapted to be separably assembled on the bottom plate 2, and each of the limit blocks 4 has a limit groove 41 and a limit portion 42. The limit groove 41 is adapted to be clamped with one of the protrusions 31. The limit portion 42 is positioned on an opposite side of the limit groove 41.

Refer to FIG. 3A and FIG. 3B. Through the above design, during use, a user may select whether the limit blocks 4 are assembled on the protrusions 31 as needed to generate different sizes of accommodating spaces (an accommodating space S1 surrounded by a dashed line in FIG. 3A and an accommodating space S2 surrounded by a dashed line in FIG. 3B; and to clearly represent a contour of the accommodating space S2, some features on the limit blocks 4 in this embodiment are omitted) by cooperation with the surrounding wall 3 or the limit portions 42 on the bottom plate 2, so as to correspond to sizes of bearing objects placed on the tray 1, without redesigning the entire tray 1. In addition, a shape of each of the limit blocks 4 in the figure is only for illustration. During actual use, various different limit blocks 4 may be designed as needed, or the limit blocks 4 are mounted on the protrusions 31 at other positions on the figure to generate various different accommodating spaces.

Figure 4A:
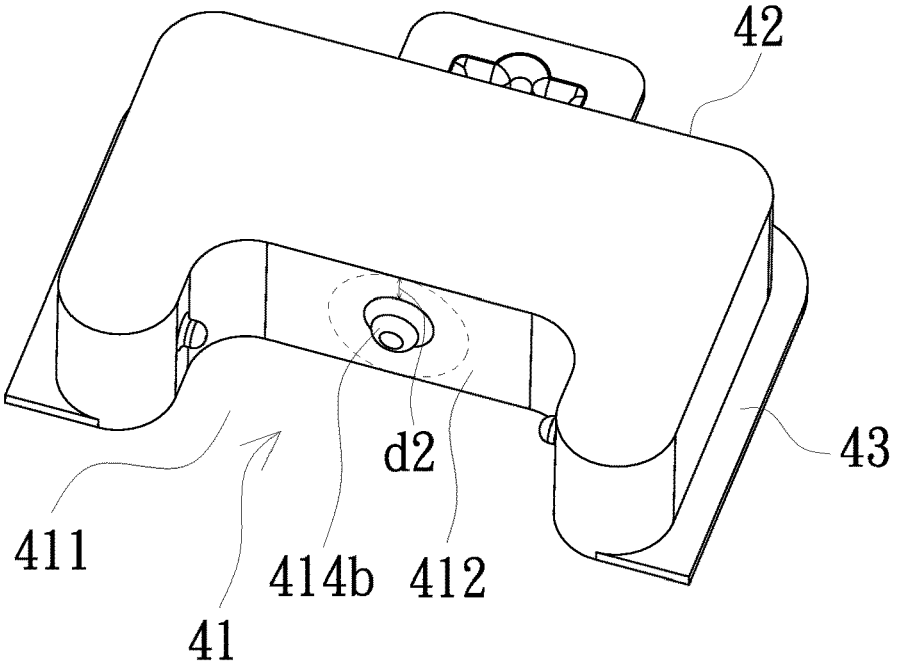
FIG. 4A is a schematic three-dimensional view of a front surface of the limit block in FIG. 1.
Figure 4B:
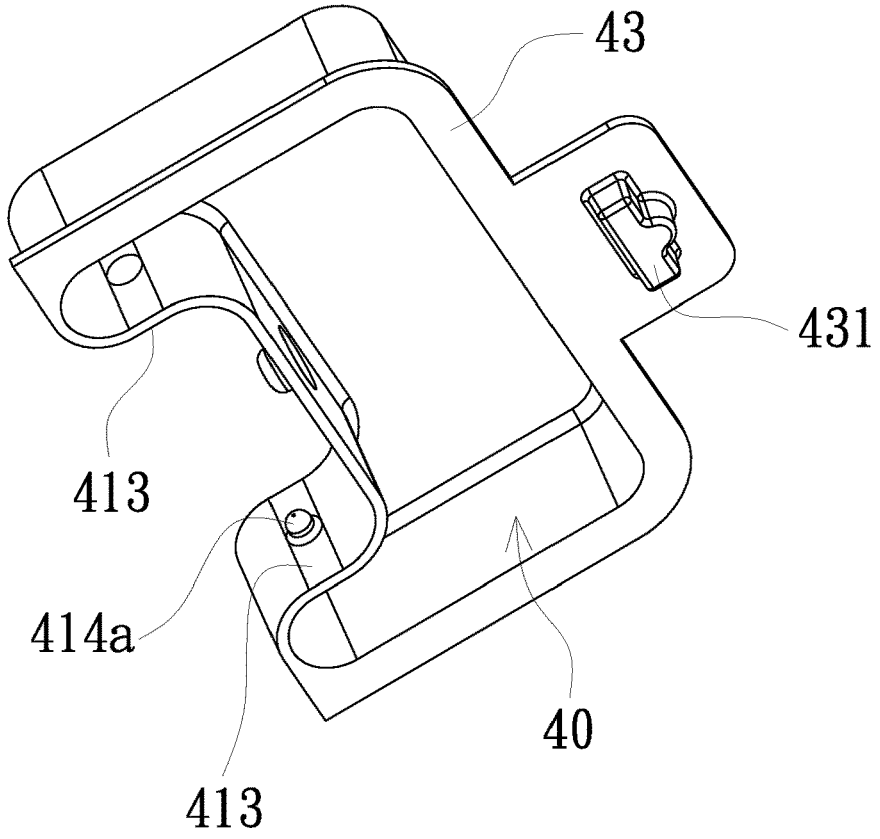
FIG. 4B is a schematic three-dimensional view of a back surface of the limit block in FIG. 1.
Figure 4C:
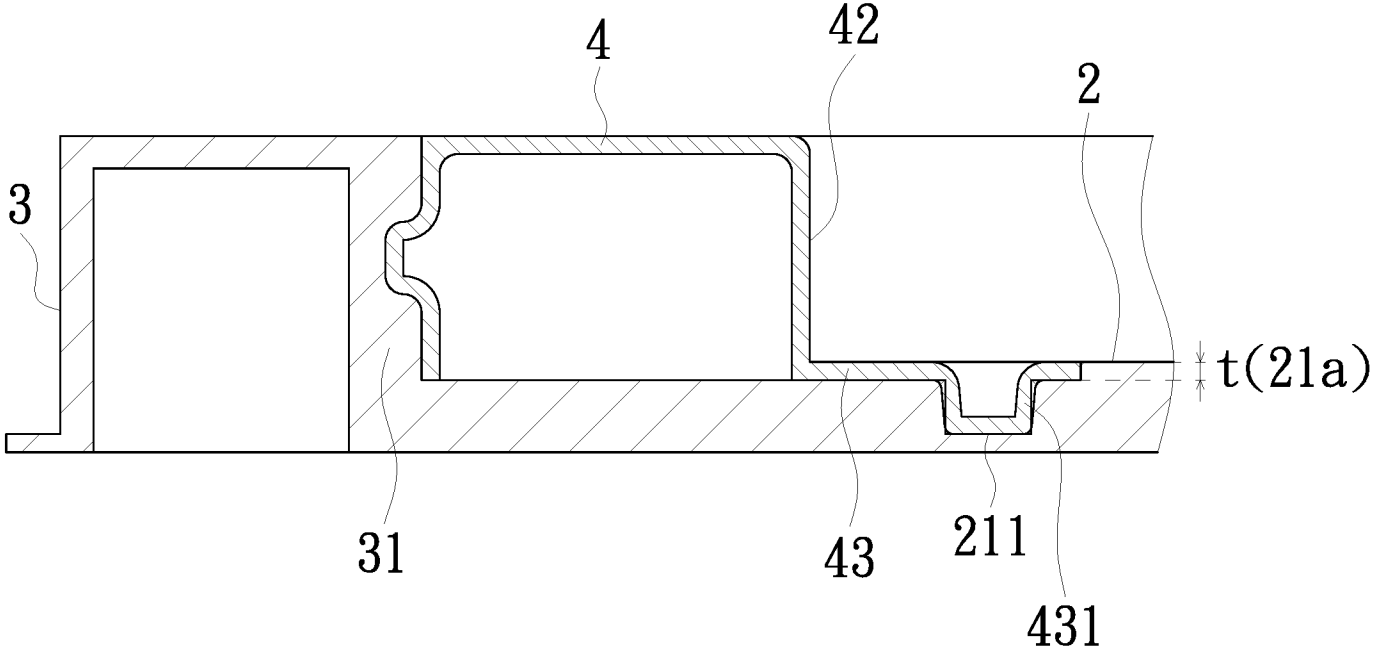
FIG. 4C is a schematic sectional view of combination of the limit block, the surrounding wall, and a bottom plate of the tray in FIG. 1.

FIG. 4A is a schematic three-dimensional view of a front surface of the limit block in FIG. 1. FIG. 4B is a schematic three-dimensional view of a back surface of the limit block in FIG. 1. FIG. 4C is a schematic view of a section A-A of the tray in FIG. 1. Referring to FIG. 1, FIG. 2, and FIG. 4A to FIG. 4C, in this embodiment, a shape of the bottom plate 2 corresponding to a product is, for example, a rectangle. For the number of the protrusions 31 on the surrounding wall 3, for example, when the surrounding wall 3 surrounds the bottom plate 2, there are two protrusions on a short side of the rectangle and three protrusions 31 on a long side of the rectangle, and each of the protrusions 31 has the same shape and size. The shape of the bottom plate 2 and the number and positions of the protrusions 31 are not limited, and may be set according to the shape of the product corresponding to the tray 1.

Refer to FIG. 2, FIG. 3A, and FIG. 3B. In this embodiment, each of the limit blocks 4 is of a thin shell structure, for example, and has an opening 40 in a side facing the bottom plate 2. A shape of the limit portion 42 is, for example, a partial contour shape (such as a straight line) corresponding to the accommodating space S2. Each of the limit blocks 4 has, for example, an outer flange 43 extending from the limit portion 42. The outer flange 43 is, for example, arranged by the limit portion 42 extending along the opening 40 to two sides of the limit groove 41 and avoiding a part where the corresponding limit block 4 contacts with the surrounding wall 3. Therefore, during combination, each surface of the limit groove 41 can contact the corresponding protrusion 31.

With respect to relevant design of combination between the limit groove 41 and the corresponding protrusion 31, in this embodiment, firstly, the limit groove 41 has, for example, a groove hole 411 and a bottom 412 opposite to the groove hole 411, and has a pair of limit walls 413 opposite to each other between the bottom 412 and the groove hole 411. Each of the limit walls 413 has a first limit structure 414*a*. The first limit structure 414*a* is adapted to be combined with a second limit structure 31*a* positioned on the corresponding protrusion 31 and arranged corresponding to a position of the first limit structure 414*a*. The bottom 412 has a third limit structure. The third limit structure is adapted to be combined with a fourth limit structure positioned on the corresponding protrusion 31 and arranged corresponding to a position of the third limit structure. The first limit structure 414*a* is, for example, a convex point protruding from the corresponding limit wall 413, while the second limit structure 31*a* is, for example, a corresponding concave hole (see FIG. 2), the third limit structure is, for example, a limit bulge 414*b* (such as the convex point, see FIG. 4A) protruding from a surface of the bottom 413, and the fourth limit structure is, for example, a corresponding limit recess 31*b* (such as the concave hole, see FIG. 2).

The first limit structure 414*a* may, for example, have a distance d2 from an edge of either side of the corresponding limit wall 413 and is, for example, positioned in a center of the corresponding limit wall 413. During assembly, for example, by means of elastic deformation of the corresponding limit block 4, the first limit structure 414*a* and the second limit structure 31*a* can be clamped with each other, without the limitation that they must be combined in a unique specific direction to be clamped with each other.

During assembly, for example, the limit blocks 4 may be combined with the protrusions 31 in a direction d1 perpendicular to the bottom plate 2 (as shown in FIG. 1 and FIG. 2), or may be combined with the protrusions 31 by moving upward along a plane of the bottom plate 2, or may be combined with the protrusions 31 at an angle of inclination to the bottom plate 2 to have a plurality of assembly directions. After combination, for the limit blocks 4 and the surrounding wall 3, the limit blocks 4 are prevented from being separated from the surrounding wall 3 along the periphery of the bottom plate 2 via the protrusions 31 and the limit grooves 41, and the limit blocks 4 are prevented from being separated from the surrounding wall 3 along openings of the groove holes 411 by clamping the first limit structures 414*a* and the second limit structures 31*a*.

Refer to FIG. 1, FIG. 2, and FIG. 4A to FIG. 4C. In this embodiment, for example, the bottom plate 2 has a plurality of grooves 21. The grooves 21 are adjacent to the protrusions 31, respectively. A contour of each of the grooves 21 corresponds to a contour of each of the limit blocks 4 (for example, corresponds to a contour of the outer flange 43), where a depth 21*a* of each of the grooves 21 is, for example, equal to a thickness t of the outer flange 43, such that a surface of the outer flange 43 and a surface of the bottom plate 2 after assembly present a continuous plane (see FIG. 4C). In addition, in the direction d1 perpendicular to the plane of the bottom plate 2, each of the limit blocks 4 has a height that is, for example, a height of the corresponding protrusion 31 in the same direction d1, to present a continuous plane with a top surface of the surrounding wall 3.

Next, refer to FIG. 1, FIG. 2, and FIG. 4A to FIG. 4C. In this embodiment, a positioning groove 211 is further arranged in each of the grooves 21, and a positioning bump 431 adapted to be mounted on the positioning groove 211 is arranged on the outer flange 43. In this embodiment, the positioning bump 431 is, for example, positioned on the outer flange 43 on an opposite side of the groove hole 411 of the limit groove 41. Therefore, after the limit blocks 4 are combined with the protrusions 31, the positioning bumps 431 will enter the positioning grooves 211 and prevent the limit blocks 4 from being separated from the protrusions 31 along the groove holes 411.

In conclusion, the tray in the present invention can form storage spaces corresponding to products of different sizes by assembling and connecting the limit blocks, so as to correspond to parts of different sizes. In addition, since the service life of the same tray can be prolonged by arranging the plurality of limit blocks with different sizes and smaller relative volumes, the inconvenience in storage and production is reduced.

What is claimed is:

1. A tray, comprising:

a bottom plate;

a surrounding wall, surrounding a periphery of the bottom plate, wherein a plurality of protrusions are arranged on an inner side of the surrounding wall; and at least one limit block, separably assembled on the bottom plate, wherein each of the limit blocks has a limit groove and a limit portion, the limit groove is adapted to be clamped with one of the protrusions, and the limit portion is positioned on an opposite side of the limit groove;

wherein each of the limit blocks is a thin shell structure and has an opening on a side thereof facing the bottom plate, and each of the limit blocks further has at least one outer flange extending from the respective limit portion.

2. The tray according to claim 1, wherein the bottom plate has a plurality of grooves adjacent to the protrusions respectively, and a contour of each of the grooves corresponds to a contour of the respective limit block.

3. The tray according to claim 2, wherein a depth of each of the grooves is equal to a thickness of the outer flange.

4. The tray according to claim 3, wherein a positioning groove is further arranged in each of the grooves, and a positioning bump adapted to be mounted on the positioning groove is arranged on the outer flange.

5. A tray, comprising:

a bottom plate;

a surrounding wall, surrounding a periphery of the bottom plate, wherein a plurality of protrusions are arranged on an inner side of the surrounding wall; and at least one limit block, separably assembled on the bottom plate, wherein each of the limit blocks has a limit groove and a limit portion, the limit groove is adapted to be clamped with one of the protrusions, and the limit portion is positioned on an opposite side of the limit groove;

wherein the limit groove has a bottom and a groove hole that are opposite to each other and two limit walls that are positioned between the bottom and the groove hole and are opposite to each other, and the two limit walls and the bottom are adapted to abut against the respective limit block.

6. The tray according to claim 5, wherein each of the limit walls has a first limit structure, and each of the protrusions is provided with a second limit structure adapted to be combined with the first limit structure.

7. The tray according to claim 6, wherein there is a distance between the first limit structure and an edge of either side of each of the limit walls.

8. The tray according to claim 5, wherein the bottom has a limit bulge, and each of the protrusions is provided with a limit recess adapted to be combined with the limit bulge.

* * * * *